US009585455B2

(12) United States Patent
Boyle et al.

(10) Patent No.: US 9,585,455 B2
(45) Date of Patent: Mar. 7, 2017

(54) NAIL POLISH CONTAINER HOLDER

(71) Applicant: Station 22, LLC, Sullivans Island, SC (US)

(72) Inventors: Elizabeth Boyle, Sullivans Island, SC (US); Mark Miclette, Sullivans Island, SC (US)

(73) Assignee: Station 22, LLC, Sullivans Island, SC (US)

( * ) Notice: Subject to any disclaimer, the term of this patent is extended or adjusted under 35 U.S.C. 154(b) by 0 days.

(21) Appl. No.: 14/683,952

(22) Filed: Apr. 10, 2015

(65) Prior Publication Data

US 2016/0295986 A1 Oct. 13, 2016

(51) Int. Cl.

| | |
|---|---|
| ***A45D 29/00*** | (2006.01) |
| ***A45D 34/04*** | (2006.01) |
| ***A45D 34/00*** | (2006.01) |
| *A45F 5/00* | (2006.01) |

(52) U.S. Cl.

CPC ..... *A45D 29/00* (2013.01); *A45D 34/00* (2013.01); *A45D 34/04* (2013.01); *A45F 5/00* (2013.01); *A45F 2005/008* (2013.01)

(58) Field of Classification Search

CPC ..... A45D 34/04; A45D 29/11; A45D 29/00; A45F 5/00; A45F 2005/008; A45F 2200/05; A44C 9/0061; A44C 9/0076; A61M 2209/083; A61M 5/008

See application file for complete search history.

(56) References Cited

U.S. PATENT DOCUMENTS

| | | | | |
|---|---|---|---|---|
| 1,283,403 | A * | 10/1918 | Eustis | A47K 1/09 206/209.1 |
| 2,140,231 | A | 12/1938 | Jefferis | |
| 2,356,722 | A | 8/1944 | Harris | |
| 2,539,940 | A * | 1/1951 | Abramson | A47G 19/2205 224/217 |
| 2,748,952 | A | 6/1956 | Fleit et al. | |
| 2,865,384 | A | 12/1958 | Noon | |
| 2,970,379 | A * | 2/1961 | Hardgrove | A61C 19/006 131/258 |

(Continued)

FOREIGN PATENT DOCUMENTS

| | | |
|---|---|---|
| AU | 2011254057 A1 | 6/2013 |
| EP | 0 026 667 A1 | 10/1981 |

(Continued)

OTHER PUBLICATIONS

International Search Report and Written Opinion of PCT/US16125129 mailed Jul. 13, 2016.

(Continued)

*Primary Examiner* — Robyn Doan

(74) *Attorney, Agent, or Firm* — Wiggin and Dana LLP; Gregory S. Rosenblatt; Jonathan D. Hall

(57) ABSTRACT

Disclosed is a holder for nail polish containers, including at least one ring portion configured to fit around a user's finger and having formed therein an opening slit, and at least one crown portion disposed above and interconnected with the ring portions. The crown has a cavity formed therein and an expandable opening configured to receive a nail polish container. The ring portions and the crown are portions of a unified body formed from a substantially pliable material.

7 Claims, 9 Drawing Sheets

(56) References Cited

U.S. PATENT DOCUMENTS

| | | | | | |
|---|---|---|---|---|---|
| 3,327,391 | A * | 6/1967 | Malm | A61C 19/006 | 206/527 |
| 3,381,814 | A * | 5/1968 | Benfield | A61C 19/00 | 206/63.5 |
| 3,900,018 | A * | 8/1975 | Piunno | A61B 17/00 | 128/897 |
| D242,646 | S * | 12/1976 | Shorin | D1/104 | |
| 4,646,953 | A | 3/1987 | Marshall et al. | | |
| 4,795,117 | A | 1/1989 | Siteman | | |
| 5,016,795 | A * | 5/1991 | Porteous | A61C 19/006 | 206/63.5 |
| 5,048,731 | A * | 9/1991 | Moreschini | A61C 19/006 | 220/270 |
| 5,112,227 | A * | 5/1992 | Bull | A61C 19/006 | 206/63.5 |
| 5,287,584 | A * | 2/1994 | Skinner | A46B 5/04 | 15/167.1 |
| 5,471,706 | A * | 12/1995 | Wallock | A61L 2/18 | 15/104.92 |
| 5,562,732 | A * | 10/1996 | Eisenberg | A61F 2/10 | 224/217 |
| 5,622,062 | A * | 4/1997 | Gong-Hwa | A44C 15/0015 | 63/1.13 |
| 5,664,711 | A | 9/1997 | Mellon | | |
| 5,732,862 | A * | 3/1998 | Bull | F16M 13/04 | 206/63.5 |
| 5,743,500 | A | 4/1998 | Northway | | |
| 5,881,734 | A | 3/1999 | Trayes | | |
| 5,882,613 | A * | 3/1999 | Gipson, II | A61L 2/18 | 132/308 |
| 5,913,312 | A * | 6/1999 | Donnell | A45D 29/22 | 132/73 |
| D453,397 | S | 2/2002 | Choi | | |
| 6,397,633 | B1 * | 6/2002 | Wu | A44C 9/0069 | 63/1.11 |
| D493,574 | S | 7/2004 | Cheeks | | |
| 6,763,681 | B1 * | 7/2004 | Klundt | A44C 9/0061 | 446/236 |
| 8,881,744 | B2 * | 11/2014 | McKinstry | A45D 44/00 | 132/216 |
| 9,144,259 | B2 * | 9/2015 | McKinstry | A41G 5/02 | |
| 2002/0178748 | A1 * | 12/2002 | Pappas-Confer | A44C 9/0084 | 63/15 |
| 2004/0096259 | A1 * | 5/2004 | Theile | A45D 34/046 | 401/7 |
| 2004/0206649 | A1 | 10/2004 | Chen | | |
| 2007/0181618 | A1 | 8/2007 | Nagy et al. | | |
| 2007/0278267 | A1 | 12/2007 | Stierstorfer | | |
| 2008/0087043 | A1 * | 4/2008 | Dussin | A44C 9/0076 | 63/33 |
| 2012/0118016 | A1 * | 5/2012 | Maloney | A44C 9/0092 | 63/15.8 |
| 2014/0272786 | A1 * | 9/2014 | Olsen | A61C 19/006 | 433/163 |
| 2014/0305459 | A1 * | 10/2014 | Friedman | A45F 5/00 | 132/200 |

FOREIGN PATENT DOCUMENTS

| | | | |
|---|---|---|---|
| EP | 0 677 258 | A1 | 10/1995 |
| WO | 2013/118091 | A1 | 8/2013 |

OTHER PUBLICATIONS

Karpati nail care from Australia.
Nail polish bottle holder.
Finger nail seat.
Rubber nail polish bottle holder stand.
Debra Lynn toe separator.
Salon services polish holder.
Berkely rubber bottle holder BottleHug Model 501.
Bottlehug bottle holder by Berkeley.
Rubber bottle holder.
Lady bug spill proof nail polish holder.

* cited by examiner

NAIL POLISH CONTAINER HOLDER

FIELD OF THE DISCLOSURE

The subject matter of the present disclosure relates to aids for applying nail polish to the hands.

BACKGROUND OF THE DISCLOSURE

The application of nail polish to one's nails can present certain challenges. For instance, one typically endeavors to complete the application of polish without allowing stray polish to contact surrounding items and surfaces, as it has a tendency to stain items and/or be difficult to remove. One must also endeavor not to tip over or otherwise allow the nail polish container to spill it contents. However, because one must frequently wet the nail polish brush, it is impractical (or in the case of a combined cap and applicator, impossible) to replace the nail polish container cap during the application process. Furthermore, placement of the nail polish container is preferably proximate to one's nails during the application process to ease the process and lessen the chance of errant polish. While in some situations placement of the container on a table or other flat surface is sufficient, in many other cases a user may be forced to place the polish container in an insecure location where it may be susceptible to spilling.

Certain hand-based holders for nail polish containers have been previously proposed. Examples include U.S. patent application Ser. No. 13/862,583, entitled "Fingernail Polishing Device and Method of Use" and filed Apr. 15, 2013, and U.S. Pat. No. 2,140,231, entitled "Finger Supported Holder for Nail Polish" and filed Jan. 25, 1937. The disclosures of U.S. patent application Ser. No. 13/862,583 and U.S. Pat. No. 2,140,231 are incorporated by reference herein in their entirety. However, previous solutions have proven impractical for a number of reasons. For instance, nail polish containers vary widely in their size and shape, and many solutions fail to adequately accommodate such variations. Other solutions force the user to maintain an impractical hand position. Despite the widespread use of nail polish in light of the problems above, the lack of a commonly-available holding apparatus is indicative that an effective solution has not been previously realized.

The subject matter of the present disclosure is directed to overcoming, or at least reducing the effects of, one or more of the problems set forth above.

BRIEF SUMMARY OF THE DISCLOSURE

Disclosed is holder that allows a user to dispose a nail polish container against the user's hand for ease of use when applying nail polish.

In an exemplary embodiment, the holder includes two finger ring portions, each having an opening slit, which accommodates various finger sizes. A crown is disposed above the finger rings and has an expandable opening configured to receive various sizes and shapes of nail polish containers.

BRIEF DESCRIPTION OF THE DRAWINGS

The foregoing summary, preferred embodiments, and other aspects of the present disclosure will be best understood with reference to a detailed description of specific embodiments, which follows, when read in conjunction with the accompanying drawings, in which.

Like reference numbers and designations in the various drawings indicate like elements.

DETAILED DESCRIPTION

Figure 1A:
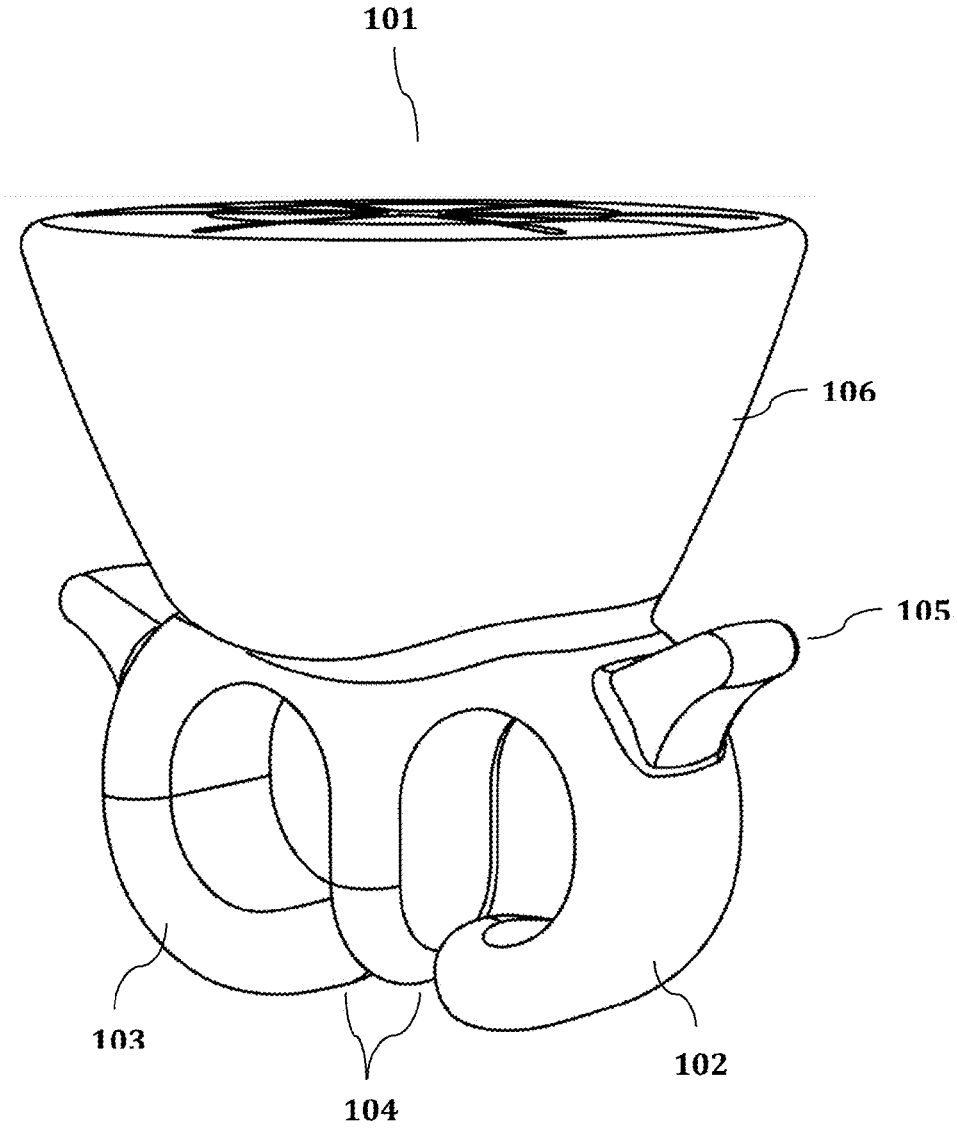
FIG. 1A is a perspective view of an embodiment nail polish container holder.

Disclosed is a holding apparatus for nail polish containers that allows a user to position a nail polish container against one's hands so that application of the nail polish is made easier.

FIG. 1 depicts an exemplary embodiment. Holder 101 has a first ring portion 102 and a second ring portion 103, each with an opening slit 104. The ring portions 102, 103 and slits 104 allow for an adjustable ring size that is easy to put on and remove from the hand. The holder may be donned in a variety of ways. For instance, it may be applied to the fingers of the wearer either aligning it with the opening slits 104 and pushing it directly down onto the fingers from above, by sliding it onto the fingers like a conventional ring, or by pushing it directly onto the fingers with the assistance of the optionally disclosed Squeeze Tabs 105, as further discussed below. A wearer may remove Holder 101 from the hand by grasping the holder and pulling directly up and off the hand.

Preferably, the shape of the ring portions 102, 103 is configured to allow the holder to be worn securely on the hand, without gripping it with the other hand. The thickness of the ring portions 102, 103 may be chosen to allow the wearer to grasp Holder 101 more securely by slightly squeezing the fingers together. The use of pliable material and the slit openings allow the ring to self-adjust to various finger sizes and shapes.

In certain embodiments, squeeze tabs are disposed on the ring portions. Specifically, optionally disposed on the outer surfaces of the respective ring portions are squeeze tabs 105. When pressure is applied to the squeeze tabs, the opening slits 104 expand to increase the diameter of the ring portions, allowing the user to more easily don the holder onto their fingers.

Crown 106 has an internal cavity formed therein (pictured in FIG. 1D) and an expandable opening to the cavity, which is configured to receive a nail polish container. Finger portions 102 and 103, as well as crown 106, are elements of a unified body formed from a substantially pliable material. For example, the holder may be formed from silicone, thermo-plastic elastomers or thermo-plastic rubbers. As will be appreciated by those of skill in the art to which the present disclosure pertains, the holder can be effectively employed with the user's hand held in the air or resting on a surface. In the embodiment, the ring thickness serves to separate the fingers by a comfortable amount, deterring smudging. Optionally, in alternative embodiments (not shown) instead of forming the finger portions and crown as a unified body, the holder can be configured such that the crown may be attached or affixed to the finger portions by conventional means, including the use of suction cups, use of adhesive material, use of Velcro-like material, or by way of a tongue and groove, male-female plug, or any other known interlocking mechanism.

Figure 1B:
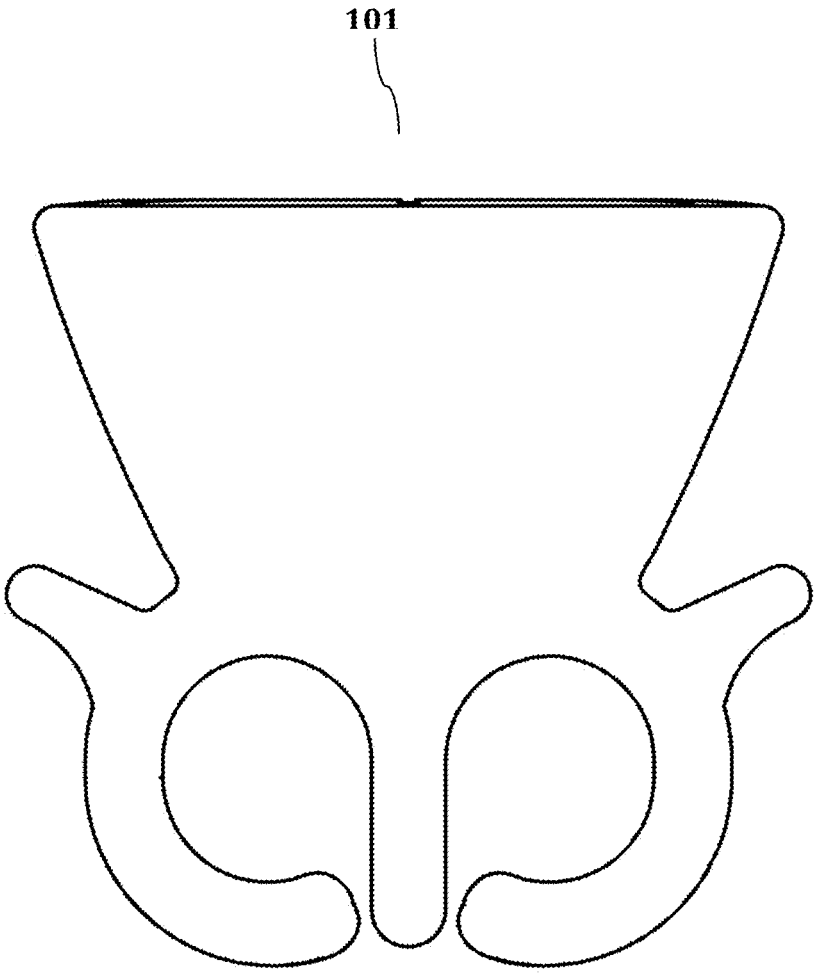
FIG. 1B is front plan view of the embodiment of FIG. 1A.
Figure 1C:
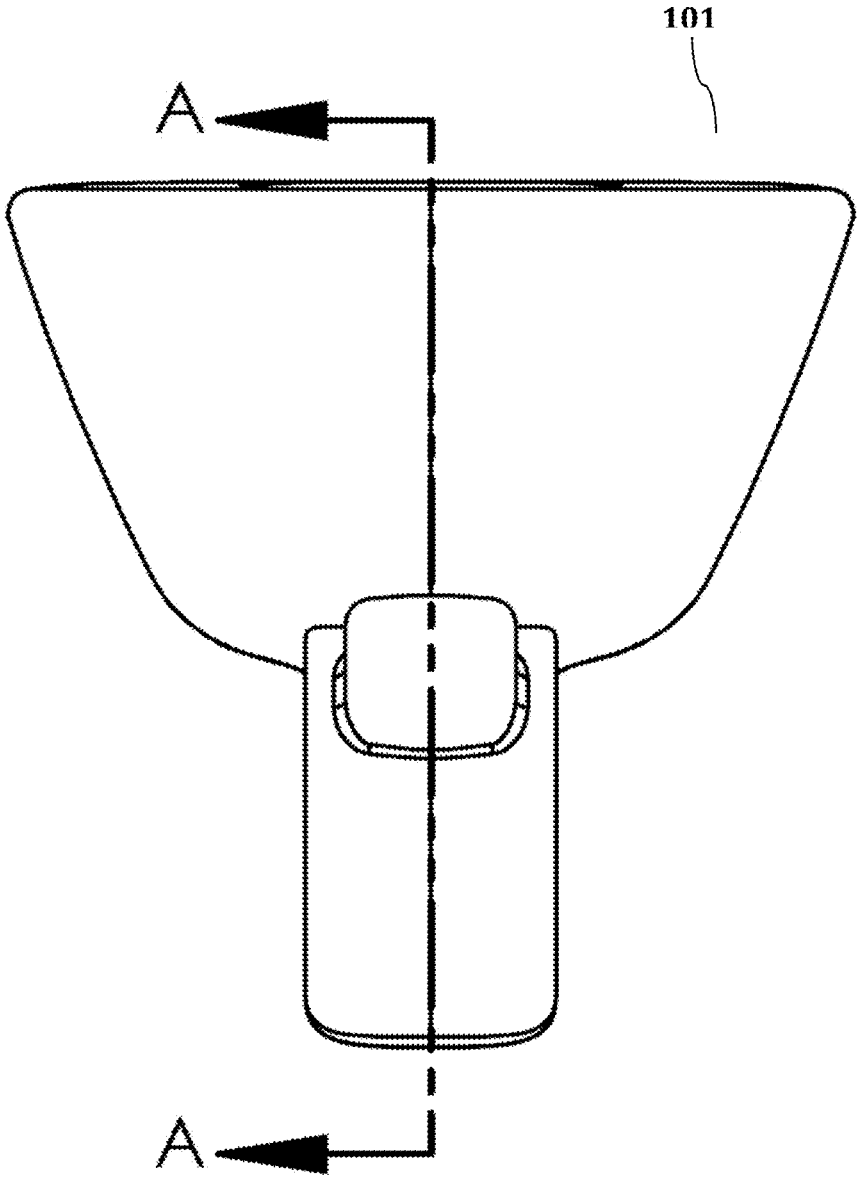
FIG. 1C is a side plan view of the embodiment of FIG. 1A.
Figure 1D:
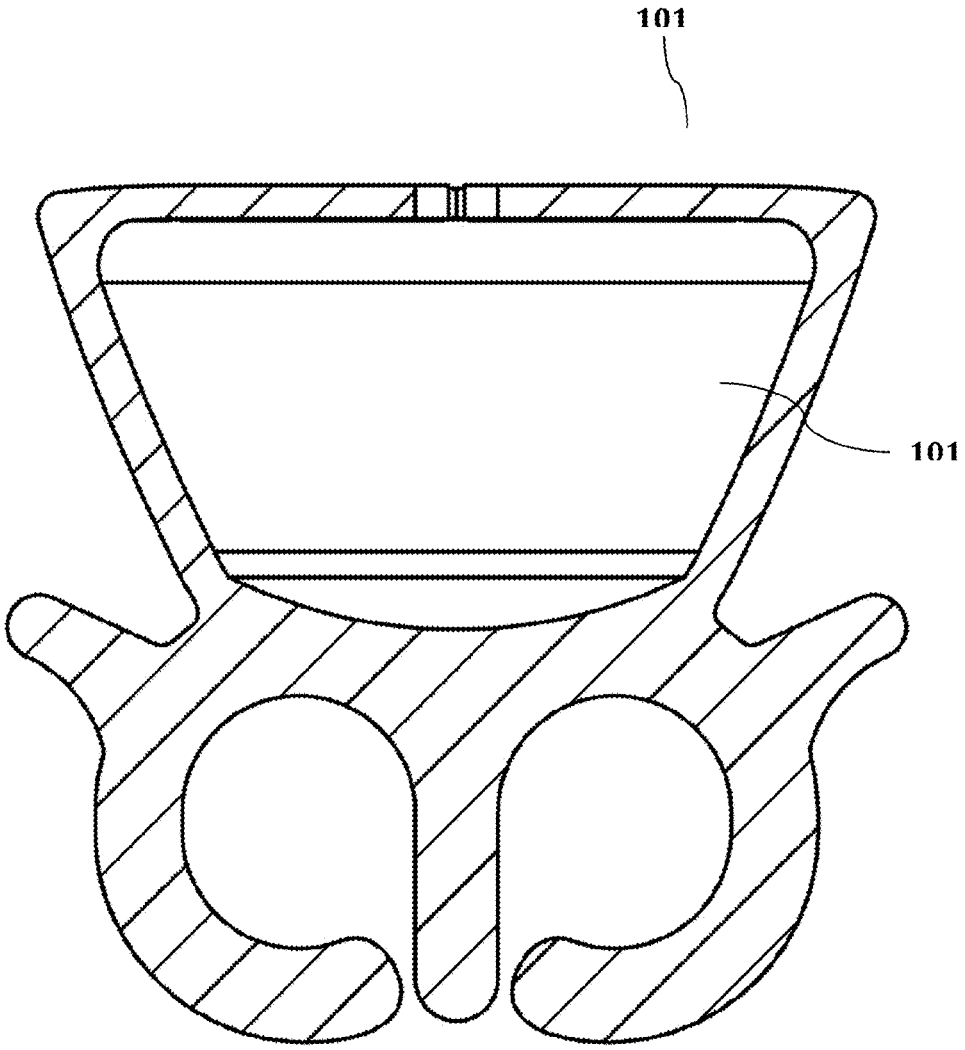
FIG. 1D is a side plan cutaway view of the embodiment of FIG. 1A dissected along the line shown in FIG. 1C.
Figure 1E:
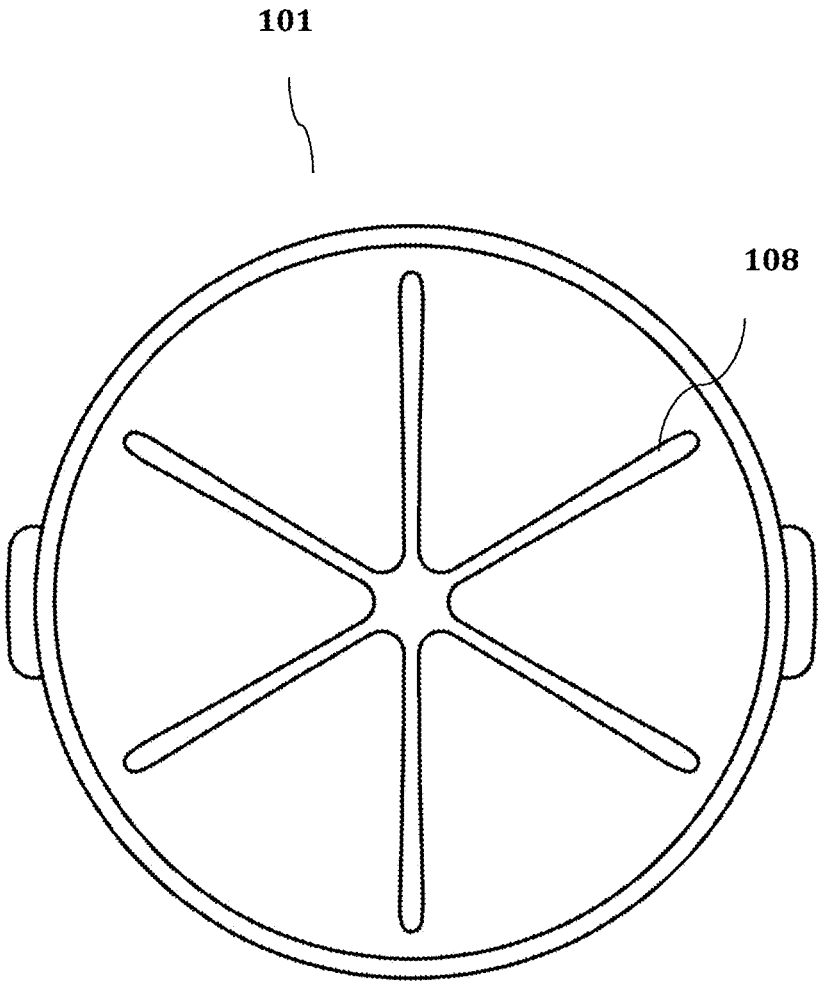
FIG. 1E is a top plan view of the embodiment of FIG. 1A.

FIGS. 1B and 1C are a front plan view and side plan view of holder 101, respectively. FIG. 1D depicts a side cutaway view along the line shown in FIG. 1C. Cavity 107 is configured to retain the nail polish container. FIG. 1E is a top plan view of holder 101. The nail polish container is inserted through slits 108 and is thereby retained for use.

The disclosed holder presents several advantages. It is compact, portable and lightweight, allowing a user to keep it readily available. The form-fitting design of the finger portions accommodate significant variety in finger sizes among users. This also has the advantage that there is less of a need to produce various sizes, reducing manufacturing costs.

In certain embodiments, several crowns are used so as to allow a user to make use of multiple nail polishes at one time.

The crown is configured to accommodate a wide range of nail polish containers of present in the market that have various shapes of base, sizes, brands, capacities, base dimensions, heights, widths, and angle of bottle. Exemplary base shapes of nail polish containers that can be accommodated by the crown include circular, square, quarter moon, oval, rectangular, triangular, and other jewel shapes. Exemplary sizes of nail polish containers that can be accommodated by the crown are mini, standard, and medium. Exemplary brands of nail polish containers that can be accommodated by the crown are Ulta, OPI, China Glaze, Nails Inc., PIXEL, Sally Beauty, Cover Girl, Sally Hansen, CND, Mineral Fusion, RUSH, ASP, Sephora, Revlon, Maybelline, NYC, Orly, Finger Paints, gelish, Nina, INM, Sinful Colors, Beauty Secrets, Cinapro, Seche, American Classics, Beauty Secrets, Nail Savvy, and FUSE. Exemplary capacities of nail polish containers that can be accommodated by the crown include 0.17-0.60 Fl. Oz. The foregoing are illustrative only. The flexible design of the crown can be configured so as to accommodate any base shape, capacity, shape, size, brand, base dimension, height, width, and angle of bottle.

Figure 2A:
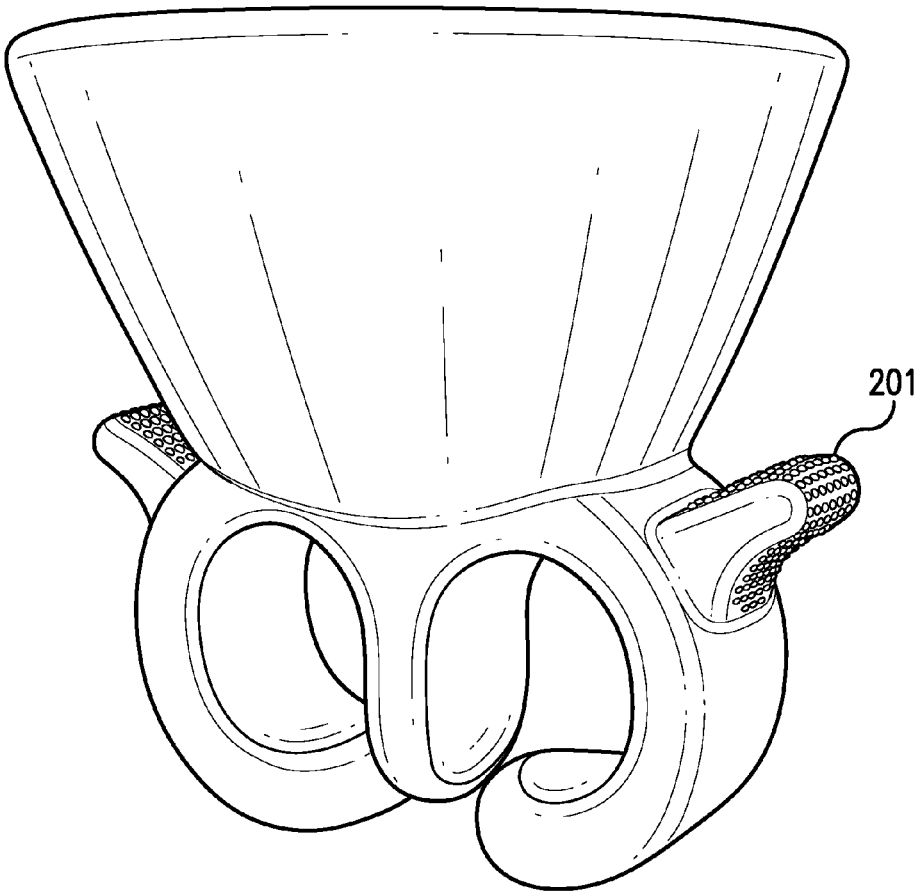
FIG. 2A is a perspective view of another embodiment having textured squeeze grips.
Figure 2B:
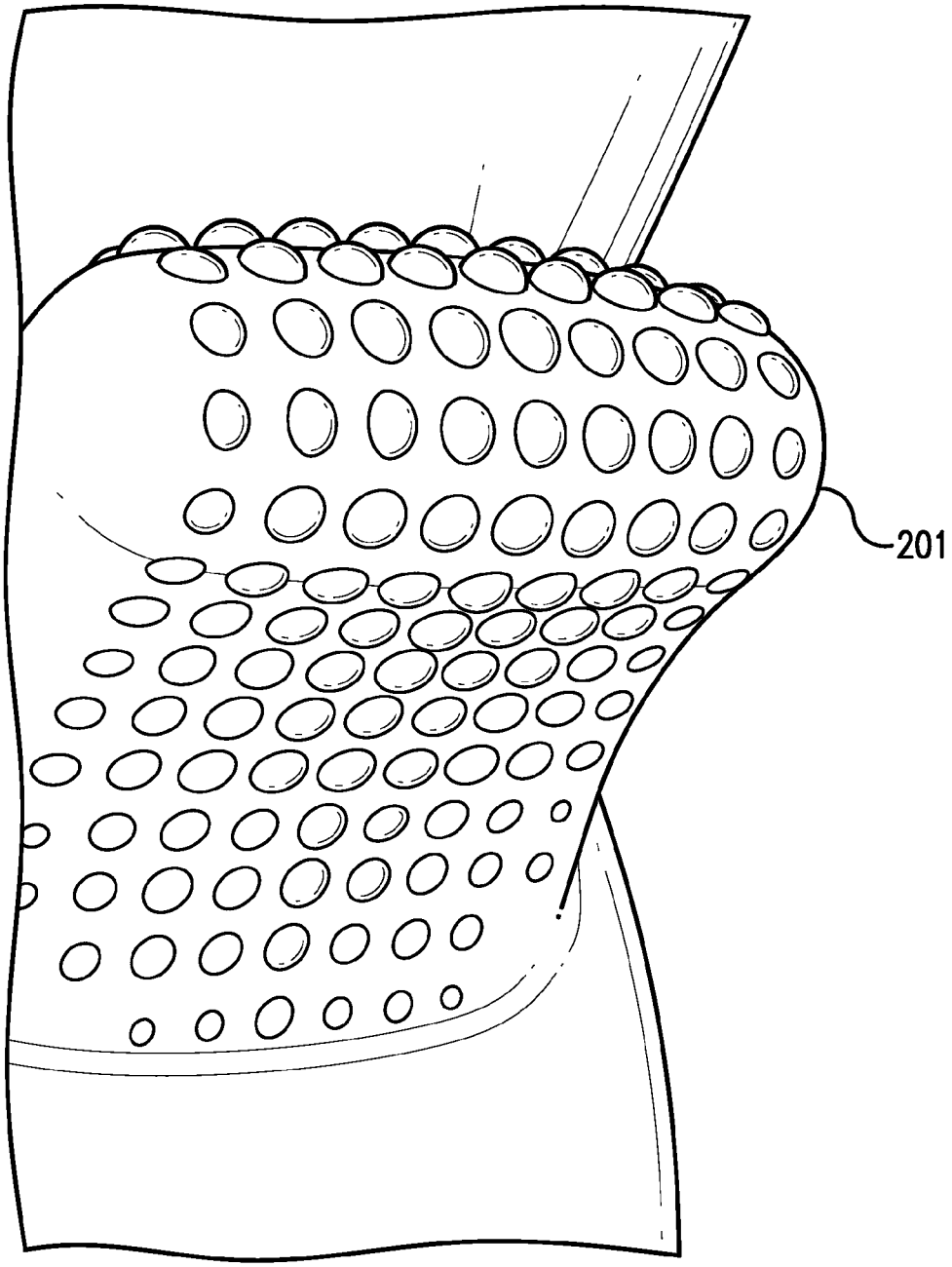
FIG. 2B is a perspective magnified view of a textured squeeze grip of the embodiment of FIG. 2A.

FIG. 2A depicts holder 201 as having squeeze tabs 202 that are textured. FIG. 2B is a close-up view of the texturing shown on squeeze tabs 202 in FIG. 2A.

While certain embodiments include two ring portions and a single crown, other variations are readily within the scope of the present disclosure. For instance, a single ring variation could be employed.

The crown is preferably configured so as to facilitate the retention of nail polish containers. For instance, contoured and tapered interior shapes accommodate various bottle circumferences, heights and shapes. Slits in the crown may be employed as an opening to the crown cavity. In certain embodiments, six slits are employed, though a single slit may also be employed. Single or multiple slits in the crown allow the bottle to be tipped as the volume of nail polish diminishes or to be tipped for on-the-go hand positions. In certain embodiments, the top of the crown is textured to add additional grip that helps hold the bottle in place. Similarly, the interior base of the crown cavity may or may not be textured to offer resistance to bottle when opening.

Figure 3A:
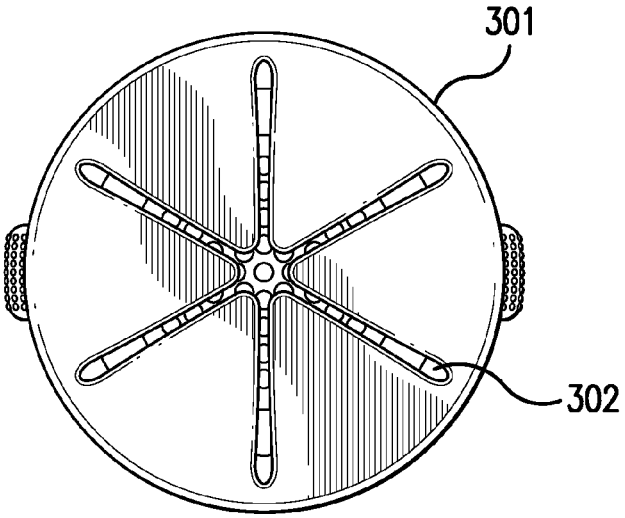
FIG. 3A is a top plan view of an embodiment.
Figure 3B:
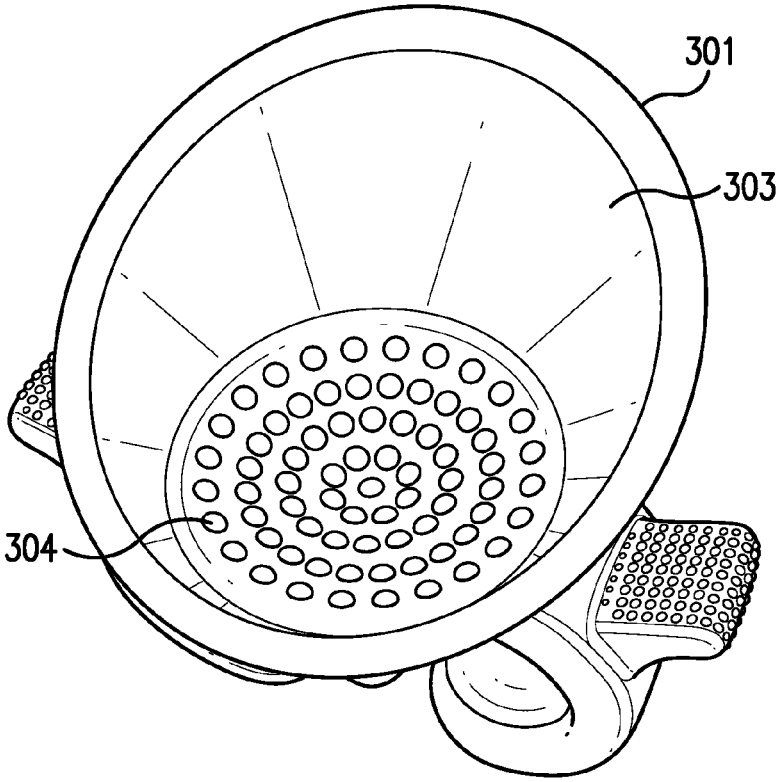
FIG. 3B is a cutaway perspective view of the embodiment of FIG. 3A.

FIG. 3A depicts a top plan view of holder 301. Slits 302 accommodate the nail polish container. FIG. 3B is a cutaway view of cavity 303 of holder 301. The interior of the crown base has nubs 303 that are designed to grip the nail polish container while holder 301 is on the hand, when the other hand is used to turn the cap while applying downward pressure.

Figure 4:
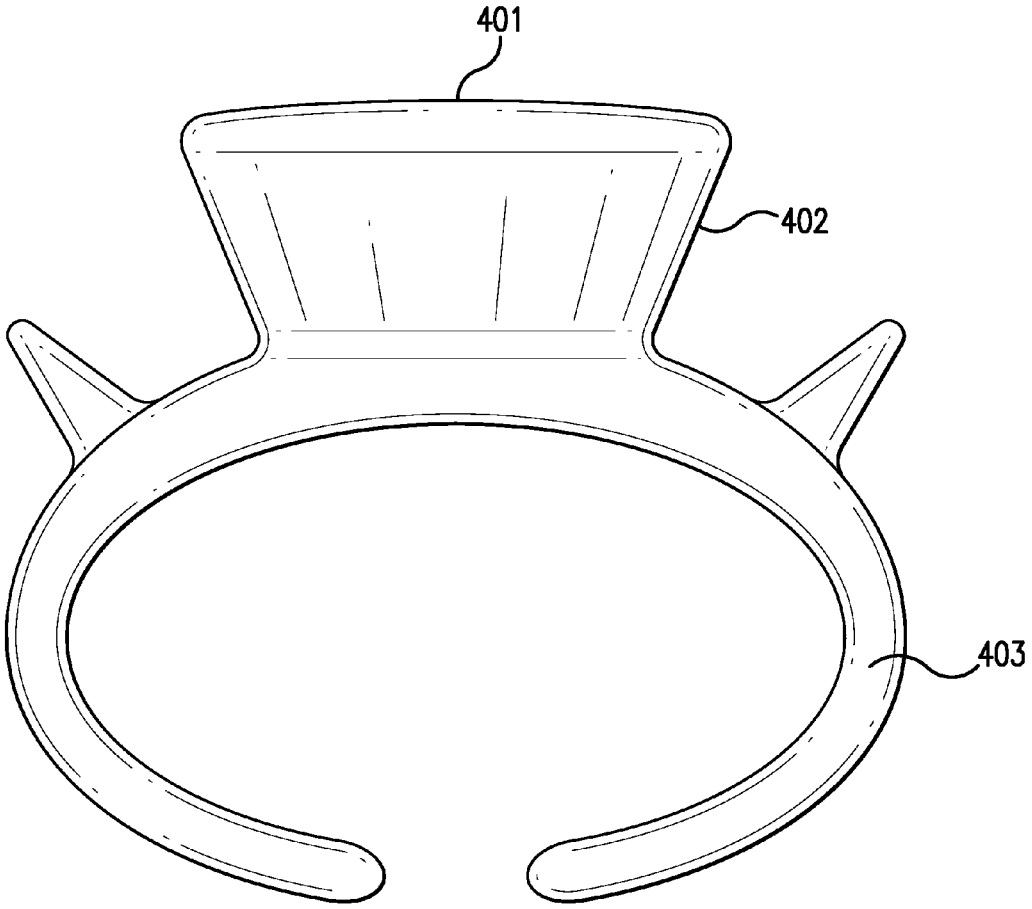
FIG. 4 is a front view of embodiment configured to be affixed to a user's wrist or lower arm.

With reference to FIG. 4, in certain alternate embodiments a single ring portion can be configured to attach to a user's wrist or lower arm. Similar to certain other embodiments, holder 401 has crown 402 and ring portion 403. However, ring portion 403 is configured to fit around a user's wrist to accommodate the preferences of certain individuals.

The disclosed holder may be manufactured in a single color, with multiple colors, or a pattern. Various applied textures, including embossing and debossing, as well as smooth surfaces may be employed. Accessories such as a leash, a hanging device, a key chain clip or other custom-style elements may be included. In certain embodiments, scents are infused in the holder's material.

Although the disclosed subject matter has been described and illustrated with respect to embodiments thereof, it should be understood by those skilled in the art that features of the disclosed embodiments can be combined, rearranged, etc., to produce additional embodiments within the scope of the invention, and that various other changes, omissions, and additions may be made therein and thereto, without parting from the spirit and scope of the present invention.

What is claimed:

1. A holder for nail polish containers, comprising:

at least two ring portions each configured to fit around one of a user's fingers;

a crown portion;

wherein each of the ring portions includes a first end that is interconnected with the crown portion and a second end distal therefrom and having a slit opening, and wherein each ring portion has formed at a location between the first end and the second end a squeeze tab wherein the squeeze tabs are collectively configured to expand the slit openings when pressure to them is applied;

wherein the crown includes a base proximate to the interconnection of the crown and the ring portions, side walls that are conical-frustum shaped extending from the base to an upper surface, and wherein the side walls have a first diameter at the base that is smaller than a second diameter at an upper surface;

wherein the base, side walls and upper surface together define a cavity;

the upper surface having formed therein least three slit openings that converge at the centroid of a horizontal plane of the upper surface and that form a plurality of triangular flaps;

wherein the crown is configured to receive a nail polish container;

wherein the base has disposed into the cavity a plurality of semispherical protrusions configured to interface with the bottom of the nail polish container; and wherein the ring portions and the crown are formed from a substantially pliable material.

2. The holder of claim 1 wherein the ring portions and crown are portions of a unified body.

3. The holder of claim 2 wherein the unified body is of one-piece molded construction.

4. The holder of claim 2 wherein the unified body is formed from one of silicone, a thermos-plastic elastomer and a thermo-plastic rubber.

5. The holder of claim 1 wherein an exterior of each squeeze tab is textured.

6. The holder of claim 1 wherein the unified body is formed from scented material.

7. The holder of claim 1 wherein the holder includes two crown portions disposed above and interconnected with the ring portion, wherein each crown portion has a cavity formed therein and an expandable opening configured to receive a nail polish container; and wherein the ring portions and the crown are portions of a unified body formed from a substantially pliable material.

* * * * *